US006273776B1

(12) United States Patent
Cha et al.

(10) Patent No.: US 6,273,776 B1
(45) Date of Patent: Aug. 14, 2001

(54) METHOD FOR MANUFACTURING ELECTRODES OF ELECTRON GUN FOR CATHODE RAY TUBE AND ELECTRODES MANUFACTURED THEREBY

(75) Inventors: Yung-bae Cha, Suwon; Yong-hwan Kim; Song-hark Lee, both of Yangsan, all of (KR)

(73) Assignee: Samsung Display Devices Co., Ltd., Kyungki-Do (KR)

( * ) Notice: Subject to any disclaimer, the term of this patent is extended or adjusted under 35 U.S.C. 154(b) by 0 days.

(21) Appl. No.: 09/176,757

(22) Filed: Oct. 22, 1998

(30) Foreign Application Priority Data

Oct. 24, 1997 (KR) ..... 97-54872

(51) Int. Cl.[7] ..... H01J 9/12
(52) U.S. Cl. ..... 445/36; 313/414
(58) Field of Search ..... 445/34, 36; 313/414

(56) References Cited

U.S. PATENT DOCUMENTS

| | | | | |
|---|---|---|---|---|
| 3,987,328 | | 10/1976 | Yoshida et al. . | |
| 4,063,340 | * | 12/1977 | Blumenberg et al. | 445/34 |
| 4,764,704 | * | 8/1988 | New et al. | 313/414 |
| 5,241,182 | | 8/1993 | Martin et al. . | |
| 5,299,965 | * | 4/1994 | Lee | 445/36 |
| 5,600,201 | * | 2/1997 | Yun et al. | 313/414 |

FOREIGN PATENT DOCUMENTS 0720203 7/1996 (EP) .

OTHER PUBLICATIONS

Patent Abstracts of Japan, Publication No. 58140949, Aug., 1983.
Patent Abstracts of Japan, Publication No. 06084501, Mar., 1994.
Patent Abstracts of Japan, Publication No. 60163335, Aug., 1985.
Patent Abstracts of Japan, Publication No. 10188845, Jul., 1998.
Derwent Publication No. AN 95–114077, Aug., 1994.

* cited by examiner

*Primary Examiner*—Kenneth J. Ramsey
(74) *Attorney, Agent, or Firm*—Lowe Hauptman; Gilman & Berner, LLP

(57) ABSTRACT

A method for manufacturing electrodes of an electron gun for a cathode ray tube and electrodes manufactured thereby are disclosed. The method for manufacturing electrodes of an electron gun for a cathode ray tube comprising the steps of preparing a first electrode member having beam passing holes, the circumferential portion of which has a predetermined thickness, and gas exhaust holes; preparing a second electrode member having a flat portion which has through holes formed to be larger than the beam passing holes and another gas exhaust holes formed to be the same as or larger than the gas exhaust holes, a side portion perpendicularly extended from the peripheral portion of the flat portion, and embedded portions perpendicularly extended from the side portion; and aligning the electrode members for the beam passing holes and gas exhaust holes of the first electrode member to respectively correspond to the through holes and gas exhaust holes of the second electrode member, and welding the electrode members to each other. With the method, the manufacture of electrodes can be performed with ease, and, in particular deformation of electrode members by mechanical and thermal stresses produced during manufacturing processes can be prevented.

18 Claims, 6 Drawing Sheets

METHOD FOR MANUFACTURING ELECTRODES OF ELECTRON GUN FOR CATHODE RAY TUBE AND ELECTRODES MANUFACTURED THEREBY

BACKGROUND OF THE INVENTION

1. Field of the Invention

The present invention relates to a method for manufacturing electrodes of an electron gun for a cathode ray tube and electrodes manufactured thereby, and more particularly, to a method for manufacturing electrodes of an electron gun by welding separate electrode members to each other, and electrodes manufactured thereby.

2. Description of the Related Art

In general, electrodes of an electron gun for a color cathode ray tube are manufactured by the steps of blanking, drawing, punching and swaging a metal sheet supplied in a strip shape, and the electrodes manufactured as above are assembled by using bead glass to be in a firmly assembled state and to form an electron gun. Among the processes for manufacturing the electrodes, the swaging step includes an action which decreases the thickness of the metal sheet to conform to a design value by pressing the metal sheet processed to have a predetermined shape. That is, the circumferential portion of a beam passing hole formed by punching is pressed to have a predetermined thickness.

The diameter of the beam passing hole and the thickness of its circumferential portion are maintained at predetermined design values in order to form an optical lens for converging an electron beam, and the thickness is relatively very thin. On the other hand, since the electrodes in itself are subject to mechanical and thermal stresses applied during manufacturing and assembling processes and thermal stresses produced by the electron beam when the electron gun as a finished product operates in the cathode ray tube, the electrodes must have a mechanical strength taking this fact into consideration. If the thickness of the circumferential portion of the beam passing hole is not formed as in design specifications due to the mechanical and thermal stresses applied to the electrodes and other reasons, it causes distortion of a beam path and finally results in degradation of the quality of the cathode ray tube. Therefore, in manufacturing the electrodes of the electron gun, the circumferential portion of the electron beam passing hole must conform to the normally very thin thickness design requirement, while the other portion must fulfill the contrary requisite of retaining relatively thick thickness to maintain the desired mechanical strength.

FIG. 1 shows a schematic section view illustrating the structure of electrodes and voltages applied to respective electrodes in a conventional electron gun.

Referring to FIG. 1, an electron gun includes three cathodes 2, a control electrode 3 and a screen electrode 4 which constitute a triode, first, second, third, and fourth focusing lenses 5, 6, 7, and 8 which constitute a main lens, and a final accelerating electrode 9 installed to face the fourth focusing lens 8. Here the three cathodes 2 are disposed linearly, and three corresponding electron beam passing holes are formed in the electrodes linearly. In addition, means 7*a*, 7*h*, 8*a* and 8*h* for forming a quadruple lens are installed in the relatively facing surfaces of the third and fourth focusing electrodes 7 and 8.

Further, a predetermined static voltage (VS) is applied to the screen electrode 4 and the second focusing electrode 6, a focusing voltage (VF) higher than the static voltage (VS) is applied to the first and third focusing electrodes 5 and 7, a dynamic focusing voltage (VD) taking the focusing voltage as a reference voltage is applied to the fourth electrode 8, and an anode voltage (VA) higher than the above voltages is applied to the final accelerating electrode 9.

FIG. 2 is a plan view of a conventional electrode, FIG. 3 is a section view taken along line III—III of FIG. 2, and FIG. 4 is a section view taken along line IV—IV of FIG. 2. Such an electrode may be one or more of the control electrode 3, the focusing electrodes and the final accelerating electrode 9 in FIG. 1.

Referring to FIG. 2, an electrode comprises generally an elliptical flat portion 21, and a side portion 22 extended in a cup shape from the flat portion 21. Embedded portions 25 are extended from the side portion 22, and have a shape as shown in FIG. 3. When the electron gun is assembled with a plurality of electrodes, the embedded portions 25 are embedded in bead glass. Beam passing holes 24 arranged linearly are perforated in the flat portion 21, the circumferential portions of the beam passing holes 24 are formed to wavy portions 23. Thermal electrons emitted from the cathodes 2 in FIG. 1 pass through the beam passing holes 24.

The wavy portions 3 formed around the circumferential portions of the beam passing holes 24 have a function of preventing a mechanical force and a thermal expansion transferred through the electrodes themselves. That is, the wavy portions 3 buffer the mechanical force applied when the embedded portions 25 are embedded in the bead glass (not shown) in a frit state, and the thermal expansion caused by the heater (not shown) of the cathode 2 to prevent the displacement of the beam passing holes 24. On the other hand, gas exhaust holes 27 are formed in the flat portion 21, and in an exhaust step for exhausting air from the cathode ray tube, are utilized to evacuate the inner space of the cathode ray tube. In addition, assembly adjusting holes 28 formed in the side portion 22 are used in inspecting an assembly state of the electrodes.

FIG. 5 is an enlarged section view of the circumferential portion of the beam passing hole.

Referring to FIG. 5, the wavy portion 23 is formed in the circumferential portion of the beam passing hole 24, the thickness ($t_2$) of the portion in the vicinity of the beam passing hole 24 is relatively thinner than that ($t_1$) of the other portion. In a conventional example, $t_2$ corresponds to about 74% of $t_1$. The reason why the thickness ($t_2$) is decided as above is for fulfilling the convergency characteristics of the electron beam in the optical lens formed by the electrode as described above, and the decrease in thickness is accomplished by the swaging process.

Decreasing the thickness of the electrode by the swaging process causes various problems in processes performed after the manufacture of the electrode. That is, since the thickness of the electrode is not uniform, thermal stresses are produced during a subsequent heat treatment as a subsequent process. Therefore, the thermal stresses may deform the shape of the electrode, and may change the position of the beam passing holes 24. Since variations in the position of the beam passing holes 24 distorts the path of the electron beam emitted from the electron gun to scan a phosphor screen, it is the decisive cause of degradation in the quality of images produced by the cathode ray tube.

SUMMARY OF THE INVENTION

To solve the above problem, it is an objective of the present invention to provide an improved method for manufacturing electrodes of an electron gun for a cathode ray tube.

It is another objective of the present invention to provide a method for manufacturing electrodes of an electron gun for a cathode ray tube, in which respective electrode members are separately formed and are welded to each other to produce an electrode.

It is still another objective of the present invention to provide electrodes of an electron gun for a cathode ray tube manufactured by the improved method.

Accordingly, to achieve the above objective, there is provided a method for manufacturing electrodes of an electron gun for a cathode ray tube comprising the steps of preparing a first electrode member having beam passing holes, the circumferential portion of which has a predetermined thickness, and gas exhaust holes, preparing a second electrode member having a flat portion which has through holes formed to be larger than the beam passing holes and another gas exhaust holes formed to be the same as or larger than the gas exhaust holes, a side portion perpendicularly extended from the peripheral portion of the flat portion, and embedded portions perpendicularly extended from the side portion, and aligning the electrode members for the beam passing holes and gas exhaust holes of the first electrode member to respectively correspond to the through holes and gas exhaust holes of the second electrode member, and welding the electrode members to each other.

According to one aspect of the present invention, the method further comprises a step of preparing a third electrode member which is welded between the first and second electrode members, which has other through holes and gas exhaust holes formed at positions corresponding to the beam passing holes and gas exhaust holes of the first electrode member.

According to another aspect of the present invention, the thickness of the first electrode member is selected to conform to a design thickness value of the circumferential portion of the beam passing holes.

According to still another aspect of the present invention, the first electrode member has a flat portion provided with the beam passing holes and the gas exhaust holes, a side portion perpendicularly extended from the flat portion, and embedded portions perpendicularly extended from the side portion.

According to still another aspect of the present invention, the circumferential portion of the beam passing holes of the first electrode member are formed for the thickness thereof to conform to a design thickness value by reducing the thickness thereof by a swaging process.

According to still another aspect of the present invention, the circumferential portion of the first electrode member is provided with a wavy portion.

To achieve the above objective, there is provided an electrode of an electron gun for a cathode ray tube having a first electrode member having beam passing holes the circumferential portion of which has a predetermined thickness, and gas exhaust holes, and a second electrode member having a flat portion which has through holes formed to be larger than the beam passing holes and another gas exhaust holes formed to be the same as or larger than the gas exhaust holes, a side portion perpendicularly extended from the peripheral portion of the flat portion, and embedded portions perpendicularly extended from the side portion, wherein the electrode members are aligned for the beam passing holes and gas exhaust holes of the first electrode member to respectively correspond to the through holes and gas exhaust holes of the second electrode member, and the electrode members are welded to each other.

BRIEF DESCRIPTION OF THE DRAWINGS

The above objectives and advantages of the present invention will become more apparent by describing in detail a preferred embodiment thereof with reference to the attached drawings in which.

DESCRIPTION OF THE PREFERRED EMBODIMENTS

Figure 1:
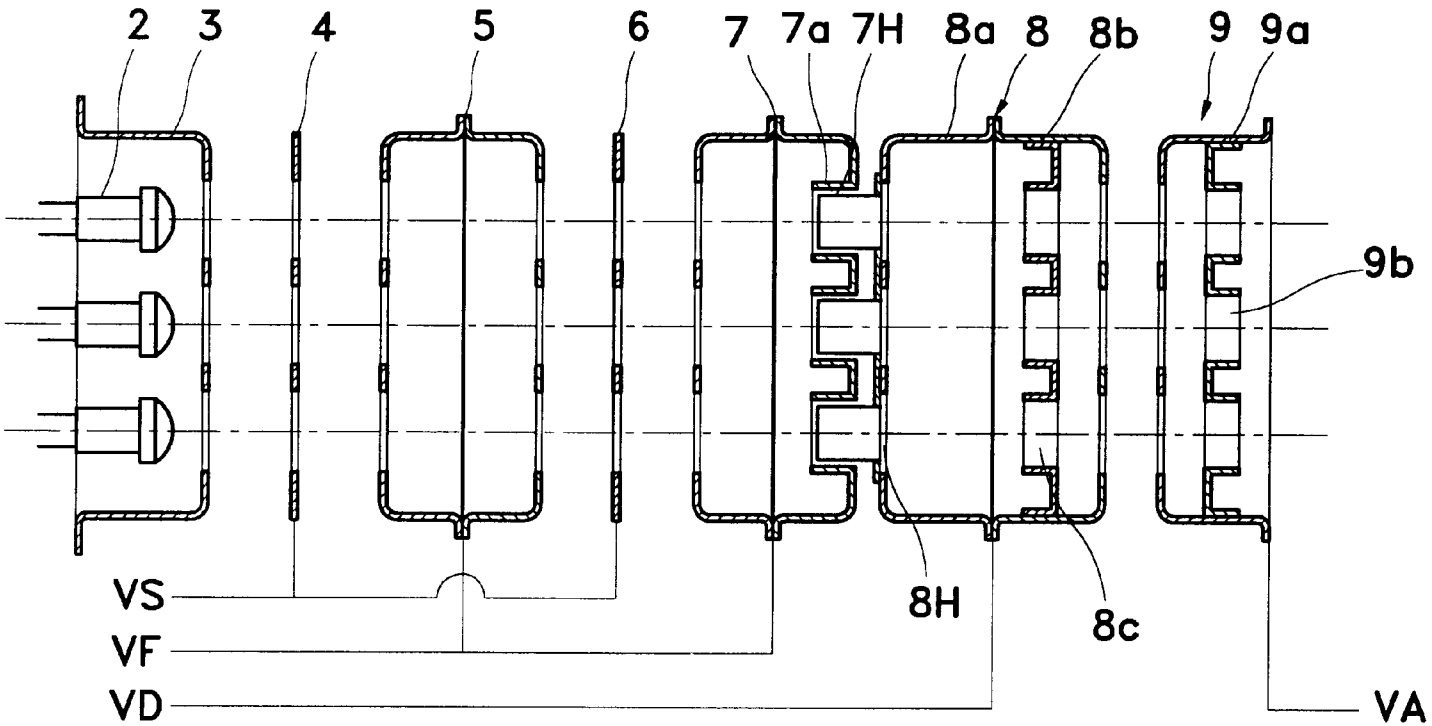
FIG. 1 is a schematic section view illustrating the structure of electrodes and voltages applied to respective electrodes in a conventional electron gun.
Figure 2:
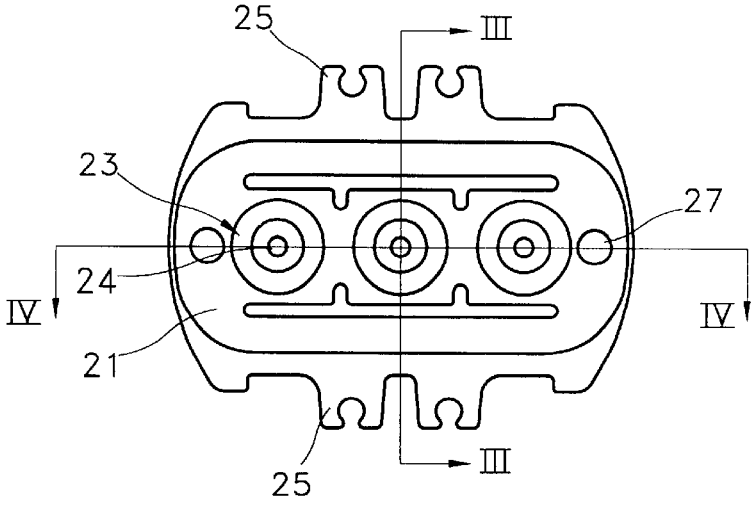
FIG. 2 is a plan view of a conventional electrode.
Figure 3:
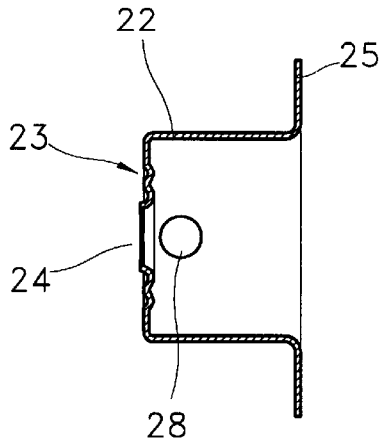
FIG. 3 is a section view taken along line III—III of FIG. 2.
Figure 4:
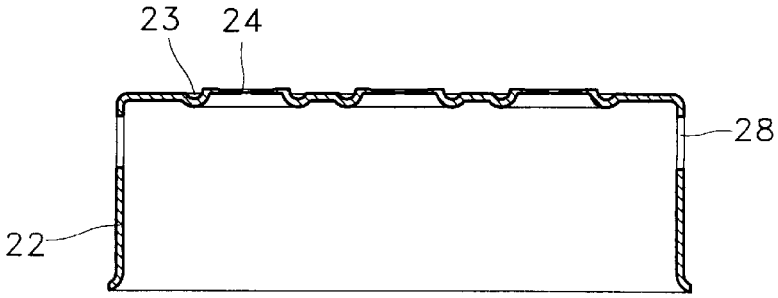
FIG. 4 is a section view taken along line IV—IV of FIG. 2.
Figure 5:
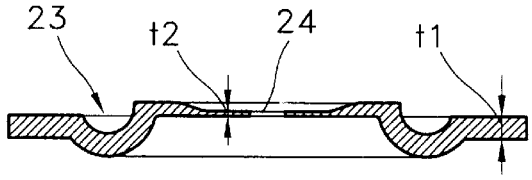
FIG. 5 is an enlarged section view of the circumferential portion of the beam passing hole.
Figure 6:
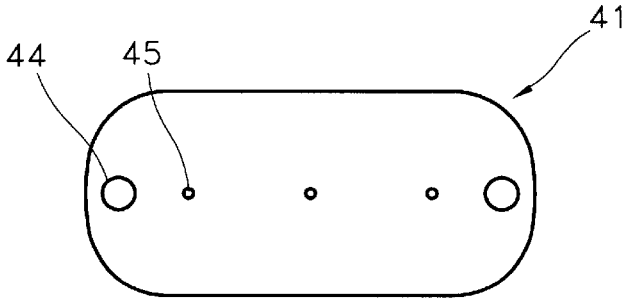
FIGS. 6, 7, and 8 are respective plan views of a main electrode member, an intermediate electrode member and an auxiliary electrode member which are manufactured by an electrode manufacturing method according to the present invention.
Figure 7:
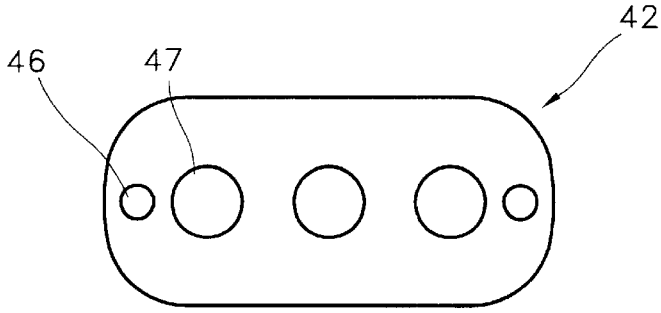
Figure 8:
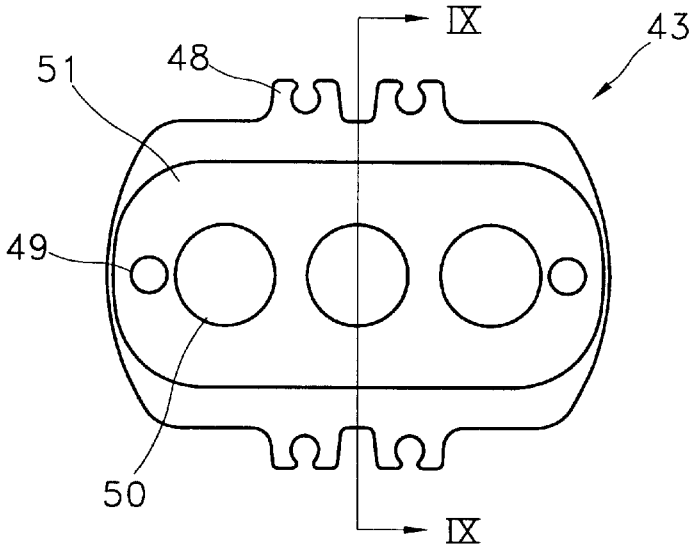
Figure 9:
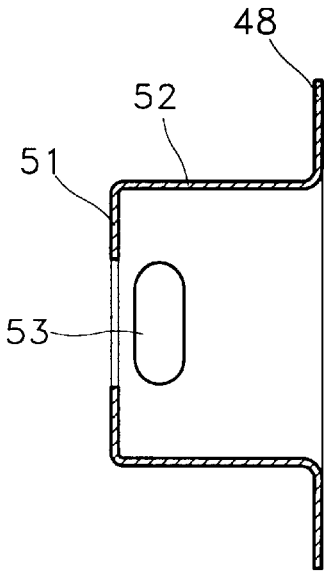
FIG. 9 is a section view taken along line IX—IX of FIG. 8.

FIGS. 6 through 8 show plan views of electrode members manufacture by an electrode manufacturing method according to the present invention, and FIG. 9 shows a section view taken along line IX—IX of FIG. 8.

Referring to FIG. 6, a main electrode member 41 is shown. The main electrode member 41 has a generally elliptical flat portion, and gas exhaust holes 44 and beam passing holes 45 are formed in the flat portion. The main electrode member 41 substantially has a function of an optical lens during operation of an electron gun, and the thickness of the main electrode member 41 is decided to conform to a design value for forming a desired optical lens.

Referring to FIG. 7, an intermediate electrode member 42 is shown. The intermediate electrode member 42 has an elliptical shape corresponding to the flat portion of the main electrode member 41. In the intermediate electrode member 42, gas exhaust holes 46 corresponding to the gas exhaust holes 44 are formed, and first through holes 47 are formed in the position corresponding to the beam passing holes 45 of the main electrode member 41. That is, when the electrode members are assembled to each other, the size and positions of the gas exhaust holes 46 correspond to those of the gas exhaust holes 44. In addition, the beam passing holes 45 are positioned at positions corresponding to the centers of the first through holes 47. That is, beams passing through the beam passing holes 45 are not affected by the first through holes 47.

Referring to FIGS. 8 and 9, the auxiliary electrode member 43 generally has a cup shape, and comprises a flat portion 51, a side portion 52 perpendicularly extended from the peripheral portion of the flat portion 51, and embedded portions 48 perpendicularly extended from the both sides of the side portion 52. The embedded portions 48 are embedded in bead glass (not shown) when the electrode is assembled.

Gas exhaust holes 49 and second through holes 50 are formed in the flat portion 51. When the electrode members are assembled, the size and positions of the gas exhaust holes 49 correspond to those of the gas exhaust holes 44 and 45 of the above-described main electrode member 41 and intermediate electrode member 42. In addition, it is preferable that the size of the second through holes 50 is the same as or larger than that of the first through holes 41 of the intermediate electrode member 42. When the electrode members are assembled, the first through holes 47 are concentrically positioned within the respective circles of the second through holes 50. Assembly adjusting holes 53 formed in the side portion 52 are formed to be capable of measuring whether the relative positions of the electrode members are maintained during assembling them.

Figure 10:
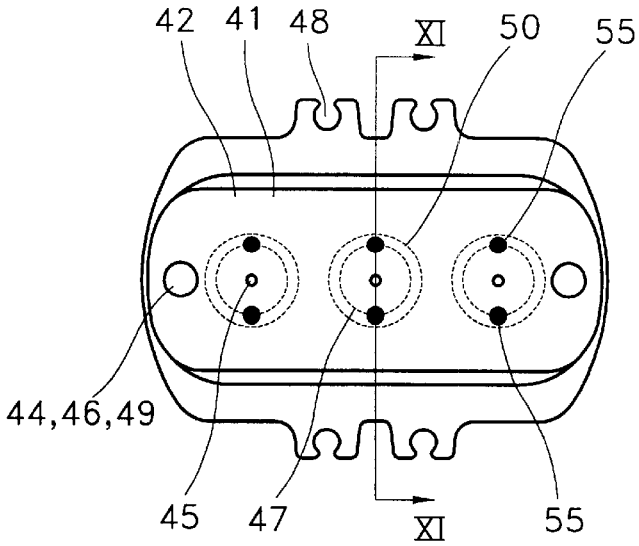
FIG. 10 is a plan view of an electrode manufactured by an electrode manufacturing method according to the present invention.
Figure 11:
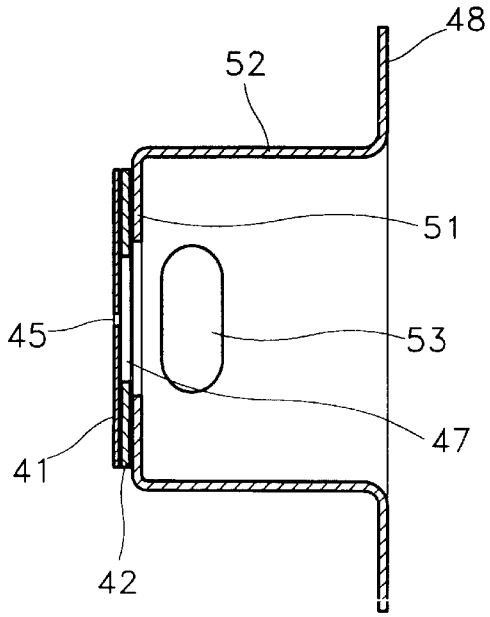
FIG. 11 is a section view taken along line XI—XI of FIG. 10.

FIG. 10 is a plan view illustrating the above-described electrode members as an assembled state, and FIG. 11 is a section view taken along line XI—XI of FIG. 10.

Referring to FIGS. 10 and 11, the intermediate electrode member 42 is welded on the auxiliary electrode member 43, and, in turn, the main electrode member 41 is welded on the intermediate electrode member 42. Since the planar contours of the main electrode member 41 and intermediate electrode member 42 correspond to each other, two members are shown in an overlapped state in a plan view. In addition, the size and positions of the gas exhaust holes 44, 46 and 49 formed in the respective electrode members correspond to each other.

The beam passing holes 45, first through holes 47 and second through holes 50 are concentrically arranged. FIG. 10 shows that such holes are disposed to be concentric to each other. Therefore, the electron beam passing through the beam passing hole 45 is not affected by respective through holes 47 and 50. Reference numeral 55 indicates welding points, and the electrode members are assembled to each other at welding points 55 by laser welding.

Though FIGS. 10 and 11 show an embodiment in which an electrode is formed with three electrode members, in other embodiments the shapes of the electrode members may be changed, or the electrode may be composed of an more or fewer electrode members. For example, in the embodiment shown in FIGS. 10 and 11, though the intermediate electrode member 42 is provided to prevent heat transfer to the main electrode member 41 provided with the beam passing holes 45 and consequent deformation of the beam passing holes 45, it should be understood that the objective of the present invention is satisfactorily attained by adjusting the thickness of the auxiliary electrode member 43 even in the case of omitting the intermediate electrode member 42. That is, the objective of the present invention is that the manufacture of electrodes can be performed with ease, and deformation of electrodes by mechanical and thermal stresses caused by various causes is effectively prevented by separately forming an electrode member provided with beam passing holes and an electrode member for supporting it.

Figure 12:
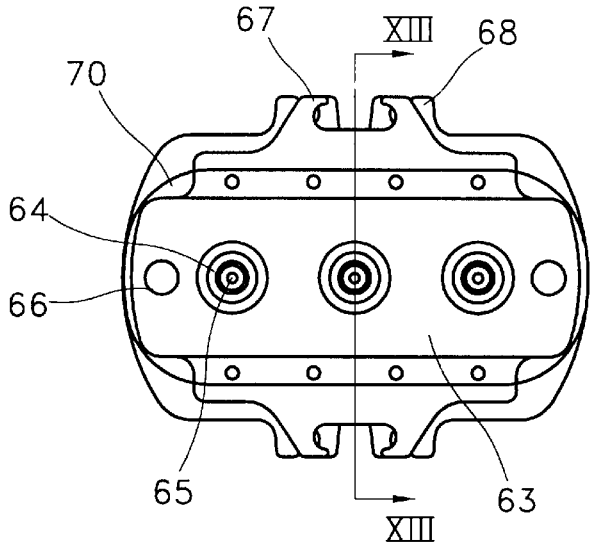
FIG. 12 is a plan view of an electrode manufactured by an electrode manufacturing method according to another embodiment of the present invention.
Figure 13:
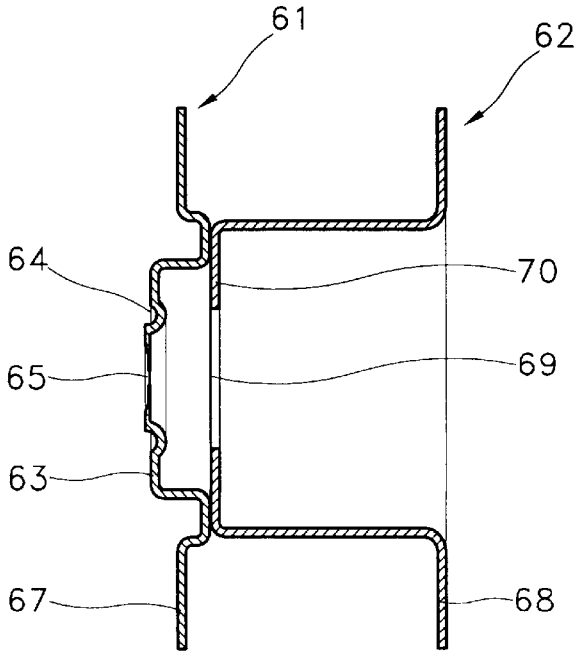
FIG. 13 is a section view taken along line XIII—XIII of FIG. 12.

FIG. 12 is a plan view of another embodiment of an electrode as an assembled state which can be manufactured within the scope of the present invention, and FIG. 13 shows a section view taken along line XIII—XIII of FIG. 12.

Referring to FIGS. 12 and 13, an electrode comprises a main electrode member 61 having a cup shape, and an auxiliary electrode member 62 also having a cup shape. The main electrode member 61 has a flat portion 63, and a side portion and embedded portion 67 extended from the flat portion 63. The flat portion 63 comprises a wavy portion 64, beam passing holes 65 formed at a position corresponding to the center of the wavy portion 64, and gas exhaust holes 66. The wavy portion 64 is formed by the above-described swaging process, and the beam passing holes 65 and gas exhaust holes 66 are formed by a punching process.

On the other hand, the auxiliary electrode member 62 has a flat portion 70, a side portion perpendicularly extended from the periphery of the flat portion 70, and embedded portions 68 perpendicularly extended from the side portion. A through hole 69 is formed in the flat portion 70. Since the through hole 69 is formed over most of the flat portion 70 of the auxiliary electrode member 62, the electron beam passing through the beam passing hole 65 is not affected by the through hole 69. The embedded portions 67 and 68 at both sides of the main electrode member 61 and auxiliary electrode member 62 are embedded in bead glass when an electron gun is assembled. The main electrode member 61 and auxiliary electrode member 62 are fixed to each other by laser welding.

Since, in a case of the electrode comprising the electrode members as described above, the main electrode member 62 can be selected to be satisfactorily thin, a conventional problem occurring in a subsequent process can be solved. In other words, even when the thickness of the circumferential portion of the beam passing hole 65 is reduced by the above-described conventional swaging process, the thickness reduction rate by the swaging process can be smaller by selecting a original sheet being thin enough for the main electrode member 61, and accordingly deformation of an electrode by the stresses caused by the subsequent heat treatment does not occur beyond the permissible range.

With the method for manufacturing electrodes of an electron gun for a color cathode ray tube according to the present invention, the manufacture of electrodes can be performed with ease, and deformation of electrode members by mechanical and thermal stresses produced during manufacturing processes can be prevented. It is an advantage that the design and control of the thickness of the peripheral portion of a beam passing hole and that of the other portion of an electrode member can be easy. On the other hand, in the electron gun for a color cathode ray tube manufactured according to the present invention, it is an advantage that variations in the position of a beam passing hole by the heat generated by a cathode of an electron gun can be prevented, and therefore high quality images can be attained.

Although a particular embodiment of the invention have been described with reference to the accompanying drawings for the purposes of illustration, it should be understood that various modifications and equivalents may be made by those skilled in the art without departing from the spirit and scope of the invention. Therefore, it will be understood that the scope of this invention is defined by the appended claims.

What is claimed is:

1. A method for manufacturing electrodes of an electron gun for a cathode ray tube comprising the steps of:

preparing a first electrode member having beam passing holes, the circumferential portion of which has a predetermined thickness, and gas exhaust holes;

preparing a second electrode member having a flat portion which has through holes formed to be larger than the beam passing holes and another gas exhaust holes formed to be larger than the gas exhaust holes, a side portion perpendicularly extended from the peripheral portion of the flat portion, and embedded portions perpendicularly extended from the side portion; and aligning the electrode members for the beam passing holes and gas exhaust holes of the first electrode member to respectively correspond to the through holes and gas exhaust holes of the second electrode member, and welding the electrode members to each other.

2. The method for manufacturing electrodes of an electron gun for a cathode ray tube as claimed in claim 1, wherein the method further comprises a step of preparing a third electrode member which is welded between the first and second electrode members, which has other through holes and gas exhaust holes formed at positions corresponding to the beam passing holes and gas exhaust holes of the first electrode member.

3. The method for manufacturing electrodes of an electron gun for a cathode ray tube as claimed in claim 1, wherein the thickness of the first electrode member is selected to conform to a design thickness value of the circumferential portion of the beam passing holes.

4. The method for manufacturing electrodes of an electron gun for a cathode ray tube as claimed in claim 1, wherein the thickness of the circumferential portion of the beam passing holes of the first electrode member is reduced by a swaging process to conform to a design thickness value.

5. The method for manufacturing electrodes of an electron gun for a cathode ray tube as claimed in claim 1, wherein the first electrode member has a flat portion provided with the beam passing holes and the gas exhaust holes, a side portion perpendicularly extended from the flat portion, and embedded portions perpendicularly extended from the side portion.

6. The method for manufacturing electrodes of an electron gun for a cathode ray tube as claimed in claim 5, wherein the thickness of the circumferential portion of the beam passing holes of the first electrode member is reduced by a swaging process to conform to a design thickness value.

7. The method for manufacturing electrodes of an electron gun for a cathode ray tube as claimed in claim 5, wherein the circumferential portion of the beam passing holes of the first electrode member is provided with a wavy portion.

8. The method for manufacturing electrodes of an electron gun for a cathode ray tube as claimed in claim 1, wherein the circumferential portion of the beam passing holes of the first electrode member is provided with a wavy portion.

9. An electrode of an electron gun for a cathode ray tube having:

a first electrode member having beam passing holes the circumferential portion of which has a predetermined thickness, and gas exhaust holes; and a second electrode member having a flat portion which has through holes formed to be larger than the beam passing holes and another gas exhaust holes formed to be larger than the gas exhaust holes, a side portion perpendicularly extended from the peripheral portion of the flat portion, and embedded portions perpendicularly extended from the side portion;

wherein the electrode members are aligned for the beam passing holes and gas exhaust holes of the first electrode member to respectively correspond to the through holes and gas exhaust holes of the second electrode member, and the electrode members are welded to each other.

10. The electrode of an electron gun for a cathode ray tube as claimed in claim 9, wherein the electrode further comprises another electrode member which is welded between the first and second electrode members, and has other through holes and gas exhaust holes formed at positions corresponding to the beam passing holes and gas exhaust holes of the first electrode member.

11. The electrodes of an electron gun for a cathode ray tube as claimed in claim 9, wherein the first electrode member has a flat portion provided with the beam passing holes and the gas exhaust holes, a side portion perpendicularly extended from the flat portion, and embedded portions perpendicularly extended from the side portion.

12. A method for manufacturing electrodes of an electron gun for a cathode ray tube comprising the steps of:

forming a first electrode member as a flat element with a set of beam passing holes and a first set of gas exhaust holes created therein;

forming a second electrode member having a flat portion with a set of through holes and a second set of gas exhaust holes, the through holes of the second electrode member being larger than the beam passing holes of the first electrode member, a side portion perpendicularly extending from a peripheral portion of the flat portion, and embedded portions perpendicularly extending from the side portion;

forming a third electrode member as another flat element with another set of through holes and a third set of gas exhaust holes;

aligning the electrode members, with the third electrode member positioned between the first and second electrode members, for the beam passing holes and gas exhaust holes of the first electrode member to respectively correspond to the through holes and gas exhaust holes of the third and second electrode members; and welding the electrode members to each other.

13. The method as claimed in claim 12, wherein a circumferential portion of the beam passing holes has a predetermined thickness.

14. A method for manufacturing electrodes of an electron gun for a cathode ray tube comprising the steps of:

forming first and second electrode members each having a flat portion with a set of gas exhaust holes created therein, a side portion perpendicularly extending from a peripheral portion of the flat portion, and embedded portions perpendicularly extending from the side portion, wherein the flat portions of the first and second electrode members further comprise a set of beam passing holes and a set of through holes, respectively, and the through holes of the second electrode member are larger than the beam passing holes of the first electrode member;

aligning the first and second electrode members, with the embedded portions of the first and second electrode members axially spaced from each other, for the beam passing holes and gas exhaust holes of the first electrode member to respectively correspond to the through holes and gas exhaust holes of the third and second electrode members; and welding the first and second electrode members to each other.

15. The method as claimed in claim 14, wherein a circumferential portion of the beam passing holes has a predetermined thickness.

16. The method as claimed in claim 15, wherein the thickness of the first electrode member is selected to conform to a design thickness value of the circumferential portion of the beam passing holes.

17. The method as claimed in claim 15, wherein the thickness of the circumferential portion of the beam passing holes of the first electrode member is reduced by a swaging process to conform to a design thickness value.

18. The method as claimed in claim 15, wherein the circumferential portion of the beam passing holes is provided with a wavy portion.

* * * * *